US010637213B2

(12) United States Patent
Dirumdam et al.

(10) Patent No.: US 10,637,213 B2
(45) Date of Patent: Apr. 28, 2020

(54) SPARK PLUG FOR AN INTERNAL COMBUSTION ENGINE HAVING A TWO-PIECE ELECTRODE AND AN ANNULAR EARTH ELECTRODE

(71) Applicant: MAN Energy Solutions SE, Augsburg (DE)

(72) Inventors: Björn Dirumdam, Ellgau (DE); Johannes Bär, Nürnberg (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 16/401,790

(22) Filed: May 2, 2019

(65) Prior Publication Data

US 2019/0341747 A1 Nov. 7, 2019

(30) Foreign Application Priority Data

May 3, 2018 (DE) ..... 10 2018 110 571

(51) Int. Cl.
*H01T 13/34* (2006.01)
*H01T 13/39* (2006.01)
*H01T 21/02* (2006.01)

(52) U.S. Cl.
CPC ..... *H01T 13/34* (2013.01); *H01T 13/39* (2013.01); *H01T 21/02* (2013.01)

(58) Field of Classification Search
CPC ..... H01T 21/02; H01T 13/39; H01T 13/20; H01T 13/32; H01T 13/36; H01T 13/34; B23K 26/28; B21K 21/08
See application file for complete search history.

(56) References Cited

U.S. PATENT DOCUMENTS 4,136,259 A * 1/1979 Djeddah ..... F23Q 3/006 174/152 S
5,563,469 A * 10/1996 Takamura ..... H01T 13/39 313/141
7,521,849 B2 * 4/2009 Havard ..... H01T 13/20 313/118
8,487,520 B2 * 7/2013 Sakayanagi ..... H01T 21/02 313/118
9,263,856 B2 * 2/2016 Kretschmar ..... H01T 21/02
2002/0079800 A1 * 6/2002 Miyashita ..... H01T 13/39 313/143
2013/0312692 A1 * 11/2013 Dirumdam ..... H01T 13/14 123/146.5 R

FOREIGN PATENT DOCUMENTS

DE 10 2011 077 279 12/2012
DE 10 2012 208 069 11/2013

* cited by examiner

*Primary Examiner* — Tracie Y Green
(74) *Attorney, Agent, or Firm* — Cozen O'Connor

(57) ABSTRACT

A spark plug with a center electrode having a first body and a second body of a precious metal, which is connected to the first body, an earth electrode arranged in the radial direction roundabout the center electrode, and an annular ignition gap formed between the center electrode and the earth electrode. The second body is formed as an annular element with a central recess. The first body has a main body and a projection, which extends into the recess of the second body. The second body is positively held on the first body via an undercut formed in the region of the projection of the first body between the first body and the second body.

11 Claims, 1 Drawing Sheet

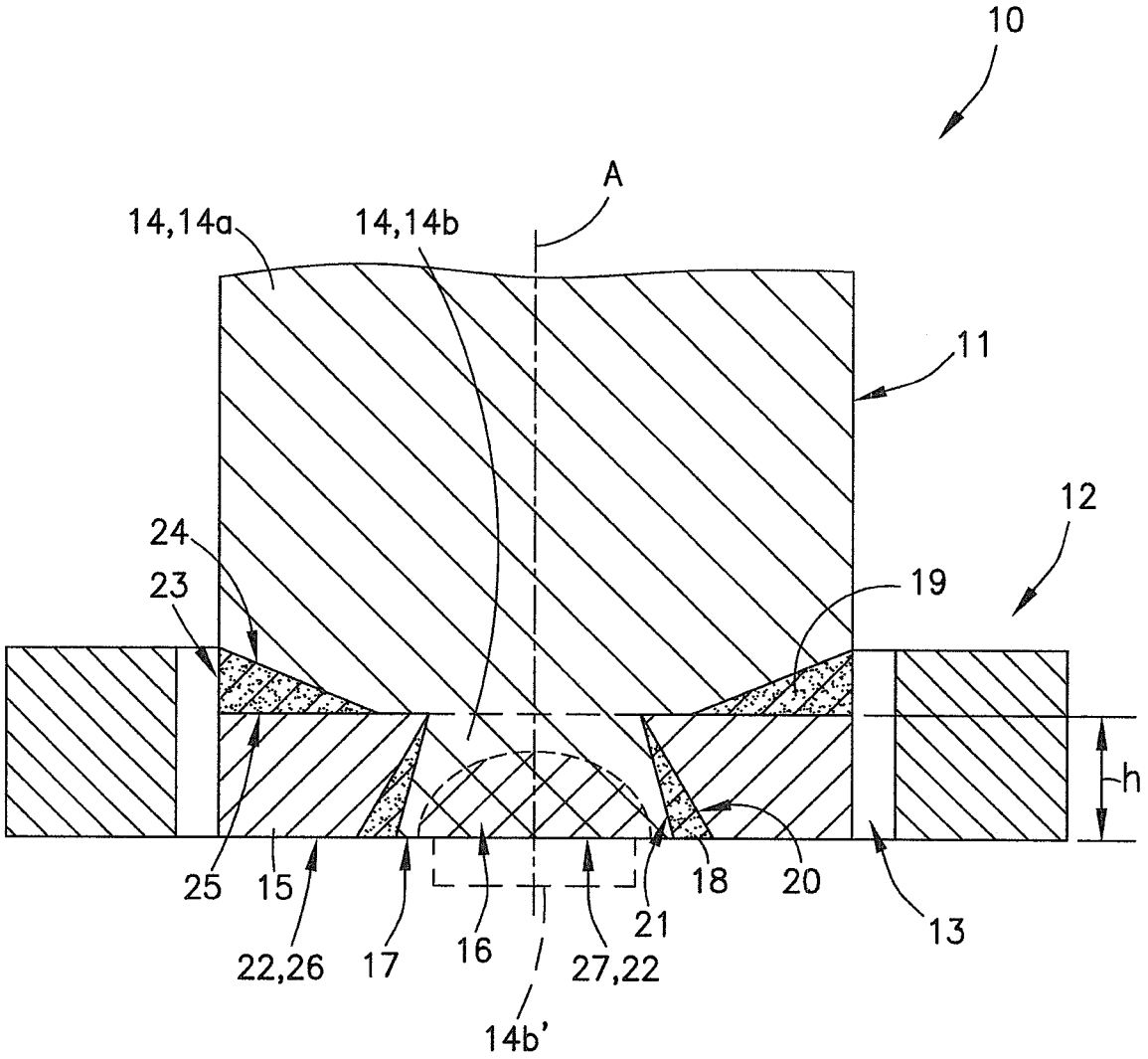
10
A
14,14a
14,14b
11
12
24
23
19
h
25
15
22,26
17
16
27,22
21
18
20
13
14b'

SPARK PLUG FOR AN INTERNAL COMBUSTION ENGINE HAVING A TWO-PIECE ELECTRODE AND AN ANNULAR EARTH ELECTRODE

BACKGROUND OF THE INVENTION

1. Field of the Invention

The invention relates to a spark plug for an internal combustion engine.

2. Description of the Related Art

Spark plugs serve for electrically igniting a fuel mixture to be combusted in an internal combustion engine. Between a so-called center-electrode and a so-called earth electrode of a spark plug an ignition gap is formed, in which for igniting the fuel mixture an electric ignition spark can form.

Spark plugs are basically distinguished between spark plugs having a hook-shaped earth electrode and spark plugs having an annular earth electrode. Accordingly, DE 10 2011 0277 279 A1 shows a spark plug whose earth electrode is formed hook-like, wherein the ignition gap seen in the axial direction of the center electrode extends axially between an end of the center electrode and an end of the hook-like earth electrode.

A spark plug having an annular earth electrode is known from DE 10 2012 208 069 A1, wherein the ignition gap extends between the center electrode and the earth electrode roundabout the center electrode.

From practice it is known that an earth electrode is composed of two bodies, namely of a first body which is produced from a basic electrode material and of a second body, which is produced from a precious metal, wherein the two bodies are connected to one another, in particular welded together.

With spark plugs known from practice there is the risk that the two bodies of the center electrode become detached from one another and the second body produced from precious metal enters the combustion chamber of the cylinder comprising the spark plug and under certain condition is discharged out of the combustion chamber into the exhaust system of the internal combustion engine. This can cause damage to the internal combustion engine.

There is therefore a need for a spark plug with which the risk that the bodies of the center electrode become detached is reduced.

SUMMARY OF THE INVENTION

One aspect of the invention is based on creating a new type of spark plug for an internal combustion engine.

The invention present here relates to a spark plug having an annular earth electrode, i.e. an ignition gap extending in the radial direction round about the center electrode.

According to one aspect of the invention, the second body of the center electrode is formed as an annular element with a central recess. The first body of the center electrode comprises a main body and a projection, which extends into the recess of the second body. The second body is positively retained via an undercut formed in the region of the projection of the first body between the first body and the second body.

The invention present here proposes for the first time to positively fix the second body of the center electrode on the first body of the center electrode via a mechanical undercut that is formed between these two bodies of the center electrode. Even upon a failure of a welded connection formed between these two bodies, the second body can be securely retained on the first body in this way. The risk of damage to the internal combustion engine is thereby minimised.

According to an advantageous further development of the invention, the recess of the second body is contoured funnel-like or conical in cross section, namely converging emanating from an axial surface of the second body, which in portions defines an end face of the center electrode, in the direction of an axial surface of the second body, located opposite an axial surface of the main body. The projection of the first body is contoured in the manner of a truncated cone or conical in the cross section, namely diverging emanating from the axial surface of the main body of the first body in the direction of an axial surface of the projection of the first body, which in portions defines the end face of the center electrode. By way of this, the mechanical undercut can be produced particularly easily and advantageously in order to positively retain the second body on the first body of the center electrode.

Preferentially, the projection of the first body is formed within the recess in the second body by forming. By way of this, the undercut can be particularly easily provided.

Preferentially, a first weld seam is formed between an axial surface of the main body of the first body and an axial surface of the second body, which preferentially, seen in the radial direction extends, emanating from a circumferential surface of the center electrode, into the same. Preferentially, additionally, a second weld seam is formed between a radially outer surface of the project of the first body and a radially inner surface of the second body delimiting the recess of the second body, which preferentially, seen in the axial direction, emanating from an end face of the center electrode, extends into the same. Preferentially, both weld seams are present. By way of this, an available weld area is increased. Even when both weld seams should fail, the second body is securely retained on the first body via the mechanical undercut.

Preferentially, a material recess is introduced into the axial surface of the projection of the first body, which in portions defines the end face of the center electrode. By way of the material recess, a stress reduction in the region of the weld seams can be provided, as a result of which the risk that the weld seams should fail can be reduced.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

The FIGURE is a schematised representation of a spark plug.

DETAILED DESCRIPTION OF THE PRESENTLY PREFERRED EMBODIMENTS

The invention present here relates to a spark plug for an internal combustion engine, in particular for a spark-ignition gas engine, which serves for igniting a fuel mixture to be combusted in the internal combustion engine.

The FIGURE shows a schematised extract from a spark plug 10 in the region of a center electrode 11 and an earth electrode 12 arranged in the radial direction roundabout the center electrode 11. Between the center electrode 11 and the earth electrode 12 an annular ignition gap 13 in the form of an annular gap or of a segmented annular gap is formed, which is provided for igniting a fuel mixture by way of an electric ignition spark forming between the center electrode 11 and the earth electrode 12.

The center electrode 11 consists of a first body 14 and a second body 15, which are connected by welding. The first body 14 consists of an electrode base material. The second body 15 consists of a precious metal.

In order to ensure a good bond between the two bodies 14, 15 of the center electrode 11 and to reduce the risk that the second body 15 consisting of the precious metal is detached from the first body 14 consisting of the electrode base material, it is provided according to one aspect of the invention that the first body 14 of the center electrode 11 has a main body 14*a* and a projection 14*b*, which with respect to the main body 14*a*, projects in the axial direction A. The second body 15 is formed as an annular element with a central recess 17, into which the projection 14*b* of the first body 14 extends. The second body 15 is positively retained on the first body 14 by way of an undercut formed in the region of the projection 14*b* of the first body 14 between the first body 14 and the second body 15. Should a welded connection, which will be discussed later on and which is formed between the two bodies 14, 15 should fail, the second body 15 is nevertheless captively retained on the first body 14 through the mechanical undercut.

For providing the mechanical undercut between the two bodies 14, 15 of the center electrode 11, the recess 17 in the second body 15 is contoured funnel-like or conical in the cross section. The recess 15 in the second body 15 is contoured conically in such a manner that the recess 17 converges, namely emanating from an axial surface 26 of the second body 15, which in portions defines an end face 22 of the center electrode 11, in the direction of an axial surface 25 of the second body 15, which is located opposite an axial surface 24 of the main body 14*a* of the center electrode 11.

The projection 14*b* of the first body 14, which extends into this recess 17 in the second body 15 of the center electrode 11 is contoured in the manner of a truncated cone in the cross section or conically, namely in such a manner that the same diverges, namely emanating from the axial surface 24 of the main body 14*a* of the first body 14 of the center electrode 11 in the direction of an axial surface 27 of the projection 14*b* of the body 15, which together with the axial surface 26 of the second body 15 defines the end face 22 of the center electrode 11.

The projection 14*b* of the first body 14, which together with the recess 17 of the second body 15 forms the mechanical undercut, is created by forming within the recess 17. Accordingly, the FIGURE shows in dashed lines a cylindrical projection 14*b*' of the first body 14 of the center electrode 11, which extends into the recess 17 in the second body 15 of the center electrode 11 and relative to the axial surface 26 of the second body 15, which in portions defines the end face 22 of the center electrode 11, projects in the axial direction A. In the radial direction, there is a significant clearance between this cylindrical projection 14*b*' and the conically contoured recess 17 of the second body 15.

By forming the cylindrical projection 14*b*', namely by plastically forming the same, the same can be transferred into the figure contoured in the manner of a truncated cone or conical in the cross section, namely subject to forming the projection 14*b*, which together with the recess 17 in the second body 15 provides the mechanical undercut for the positive fixing of the second body 15 on the first body 14.

To additionally connect the second body 15 and the first body 14 in a firmly bonded manner, two weld seams 18, 19 are preferentially formed.

A weld seam 18 is formed between a radially outer surface 20 of the projection 14*b* of the first body 14 which is contoured in the manner of a truncated cone and a radially inner surface 21 of the second body 15 which is contoured funnel-like and which delimits the recess 17 of the second body 15. This weld seam 18, seen in the axial direction A, extends emanating from the end face 22 of the center electrode 11 into the same, wherein a penetration depth of this weld seam 18 into the center electrode 11 approximately corresponds to the axial length h of the formed projection 14*b* of the first body 14.

A weld seam 19 is formed between the axial surface 24 of the main body 14*a* of the first body 14 and the adjoining axial surface 25 of the second body 15. Emanating from a circumferential surface 23 of the center electrode 11, this weld seam 19 extends into the same, wherein the penetration depth of this weld seam 19 corresponds to the radial distance between the circumferential surface 23 of the center electrode 11 and the projection 14*b* of the first body 14.

The weld seams 18, 19 each have a relative low penetration depth but, combined, provide a high available weld area which can be reliably formed. If only a single weld seam is present, this should preferentially be the weld seam 19.

Particularly preferably it is provided that in the axial surface 27 of the projection 14*b* of the first body 14, which in portions defines the end portions 22 of the center electrode 11, a material recess 16 is introduced, which is preferentially contoured parabolically. By way of the optional material recess 16, stresses in the welding zone can be reduced, as a result of which the risk of a failure of the welded connection can be reduced.

There is a reduced risk for the center electrode 11 of the spark plug 10 according to the invention that the second body 15 of the center electrode 11 produced from precious metal, unintentionally is detached from the first body 14 of the center electrode 11 produced from the electrode base material. A further advantage of the spark plug 10 consists in that because of the recess 17 in the second body 15 of the center electrode 11, less precious metal is needed. This reduces the production costs of the spark plug 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A spark plug for an internal combustion engine, comprising:

a center electrode, comprising:

a first body made from an electrode base material having:

a main body;

a projection; and an undercut formed in a region of the projection of the first body; and a second body formed as an annular element with a central recess and made from a precious metal, which is welded to the first body, wherein the projection of the first body extends into the central recess of the second body, wherein the second body is positively captively retained on the first body by way of the undercut formed in the region of the projection of the first body between the first body and the second body;

an earth electrode arranged in a radial direction around the center electrode; and an annular ignition gap formed between the center electrode and the earth electrode configured to ignite a fuel mixture by way of an electric ignition spark forming between the center electrode and the earth electrode.

2. The spark plug according to claim 1, wherein the central recess in the second body is contoured one of funnel-like and conical in cross section, converging emanating from an axial surface of the second body, which in portions defines an end face of the center electrode, towards an axial surface of the second body, which is located opposite an axial surface of the main body.

3. A spark plug for an internal combustion engine, comprising:

a center electrode, comprising:

a first body made from an electrode base material having:

a main body;

a projection; and an undercut formed in a region of the projection of the first body; and a second body formed as an annular element with a central recess and made from a precious metal, which is welded to the first body, wherein the projection of the first body extends into the central recess of the second body, wherein the second body is positively retained on the first body by way of the undercut formed in the region of the projection of the first body between the first body and the second body;

an earth electrode arranged in a radial direction around the center electrode; and an annular ignition gap formed between the center electrode and the earth electrode configured to ignite a fuel mixture by way of an electric ignition spark forming between the center electrode and the earth electrode, wherein the projection of the first body is contoured as one of a truncated cone or conical in cross section, diverging from an axial surface of the main body of the first body towards an axial surface of the projection of the first body, which in portions defines an end face of the center electrode.

4. The spark plug according to claim 1, wherein the projection of the first body is created by forming within the central recess in the second body.

5. A spark plug for an internal combustion engine, comprising:

a center electrode, comprising:

a first body made from an electrode base material having:

a main body;

a projection; and an undercut formed in a region of the projection of the first body; and a second body formed as an annular element with a central recess and made from a precious metal, which is welded to the first body, wherein the projection of the first body extends into the central recess of the second body, wherein the second body is positively retained on the first body by way of the undercut formed in the region of the projection of the first body between the first body and the second body;

an earth electrode arranged in a radial direction around the center electrode; and an annular ignition gap formed between the center electrode and the earth electrode configured to ignite a fuel mixture by way of an electric ignition spark forming between the center electrode and the earth electrode, wherein a first weld seam is formed between an axial surface of the main body of the first body and an axial surface of the second body, which seen in a radial direction extends emanating from a circumferential surface of the center electrode.

6. The spark plug according to claim 5, wherein a second weld seam is formed between a radially outer surface of the projection of the first body and a radially inner surface of the second body delimiting the central recess of the second body, which seen in axial direction extends emanating from an end face of the center electrode into the center electrode.

7. The spark plug according to claim 6, wherein a penetration depth of the second weld seam corresponds to an axial length (h) of the projection of the first body.

8. The spark plug according to claim 5, wherein a penetration depth of the first weld seam corresponds to a radial distance between the circumferential surface of the center electrode and the projection of the first body.

9. The spark plug according to claim 3, wherein a material recess is introduced in the axial surface of the projection of the first body, which in portions defines the end face of the center electrode.

10. The spark plug according to claim 9, wherein the material recess is parabolically contoured.

11. The spark plug according to claim 1, wherein the second body is positively retained on the first body by the undercut when a weld between the first body and the second body fails.

* * * * *